US007360857B2

(12) United States Patent
Koshikawa

(10) Patent No.: US 7,360,857 B2
(45) Date of Patent: Apr. 22, 2008

(54) INK JET PRINTING APPARATUS AND INK JET PRINTING METHOD

(75) Inventor: Masahiro Koshikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 11/145,932

(22) Filed: Jun. 7, 2005

(65) Prior Publication Data

US 2005/0275672 A1 Dec. 15, 2005

(30) Foreign Application Priority Data

Jun. 10, 2004 (JP) ..... 2004-173076

(51) Int. Cl.
*B41J 29/38* (2006.01)
*B41J 2/01* (2006.01)

(52) U.S. Cl. ..... 347/16; 347/102

(58) Field of Classification Search ..... 347/16, 347/102

See application file for complete search history.

(56) References Cited

U.S. PATENT DOCUMENTS 6,652,060 B2 11/2003 Uchida
6,938,974 B2 9/2005 Uchida
2002/0024574 A1 2/2002 Uchida
2004/0095406 A1 5/2004 Uchida
2004/0263553 A1* 12/2004 Mizuno ..... 347/16

FOREIGN PATENT DOCUMENTS

JP 6-134982 A 5/1994
JP 2879872 B 1/1999
JP 2003-48311 A 2/2003

* cited by examiner

*Primary Examiner*—Julian D. Huffman
(74) *Attorney, Agent, or Firm*—Fitzpatrick, Cella, Harper & Scinto

(57) ABSTRACT

An ink jet printing apparatus is provided which prevents a jam and a head-medium rubbing during a double-sided printing and which can reduce a time required for the printing. The standby time from when the printing on the first print surface of a print medium is completed until the printing on the second print surface starts is set according to the amount of ink applied to a particular area in the first print surface of the print medium. After the set standby time elapses from the completion of the printing on the first print surface, an operation associated with the printing on the second print surface is started.

13 Claims, 13 Drawing Sheets

| AMOUNT OF INK APPLIED(M) | LENGTH OF TIME(T) |
|---|---|
| $0 \leqq M < m_1$ | $T=t_1$ |
| $m_1 \leqq M < m_2$ | $T=t_2$ |
| $m_2 \leqq M < m_3$ | $T=t_3$ |
| $m_3 \leqq M$ | $T=t_4$ |

FIG.10

| PRINT MEDIUM | AMOUNT OF INK APPLIED(M) | LENGTH OF TIME(T) |
|---|---|---|
| PLAIN PAPER | $0 \leqq M < m_1$ | $T=t_{a1}$ |
| | $m_1 \leqq M < m_2$ | $T=t_{a2}$ |
| | $m_2 \leqq M < m_3$ | $T=t_{a3}$ |
| | $m_3 \leqq M$ | $T=t_{a4}$ |
| COATED PAPER | $0 \leqq M < m_1$ | $T=t_{b1}$ |
| | $m_1 \leqq M < m_2$ | $T=t_{b2}$ |
| | $m_2 \leqq M < m_3$ | $T=t_{b3}$ |
| | $m_3 \leqq M$ | $T=t_{b4}$ |
| GLOSSY PAPER | $0 \leqq M < m_1$ | $T=t_{c1}$ |
| | $m_1 \leqq M < m_2$ | $T=t_{c2}$ |
| | $m_2 \leqq M < m_3$ | $T=t_{c3}$ |
| | $m_3 \leqq M$ | $T=t_{c4}$ |

FIG.11

| | | DIVIDED AREAS OF FRONT SURFACE | | | | | |
|---|---|---|---|---|---|---|---|
| | | Ea | Ea' | Eb | Eb' | Ec | Ed |
| AMOUNT OF INK APPLIED (M) | $0 \leqq M < m_1$ | $T=t_{a1}$ | $T=t_{a'1}$ | $T=t_{b1}$ | $T=t_{b'1}$ | $T=t_{c1}$ | $T=t_{d1}$ |
| | $m_1 \leqq M < m_2$ | $T=t_{a2}$ | $T=t_{a'2}$ | $T=t_{b2}$ | $T=t_{b'2}$ | $T=t_{c2}$ | $T=t_{d2}$ |
| | $m_2 \leqq M < m_3$ | $T=t_{a3}$ | $T=t_{a'3}$ | $T=t_{b3}$ | $T=t_{b'3}$ | $T=t_{c3}$ | $T=t_{d3}$ |
| | $m_3 \leqq M$ | $T=t_{a4}$ | $T=t_{a'4}$ | $T=t_{b4}$ | $T=t_{b'4}$ | $T=t_{c4}$ | $T=t_{d4}$ |

| AMOUNT OF INK APPLIED(M) | LENGTH OF TIME(T) |
|---|---|
| $0 \leqq Mn < m_1$ | $T_{Mn} = t_1$ |
| $m_1 \leqq Mn < m_2$ | $T_{Mn} = t_2$ |
| $m_2 \leqq Mn < m_3$ | $T_{Mn} = t_3$ |
| $m_3 \leqq Mn$ | $T_{Mn} = t_4$ |

INK JET PRINTING APPARATUS AND INK JET PRINTING METHOD

BACKGROUND OF THE INVENTION

1. Field of the Invention

The present invention relates to an ink jet printing apparatus and method to eject ink for printing according to a print signal and more particularly to an ink jet printing apparatus and method having a double-sided printing function.

2. Description of the Related Art

As information processing equipment, such as copying machines, word processors and computers, and communication equipment proliferate, ink jet printing apparatus are becoming increasingly widespread as one of image forming output devices for these equipment. Ink jet printing apparatus employ an ink jet system that ejects ink from orifices of a print head to form a digital image. The print head of such printing apparatus has a large number of ink ejection nozzles and ink paths integrated therein at high density for high resolution printing. In recent years, there are growing calls for printing color images. Many ink jet printing apparatus meet this demand for color image printing by mounting a plurality of print heads ejecting different colors of ink.

The ink jet printing system performs a dot printing by ejecting ink as a recording liquid in the form of flying droplets to land on a print medium such as paper. That is, the ink jet printing system is a non-contact printing system in which the print medium and the print head are kept out of contact with each other during printing, so its operating noise is low. Further, the ink jet printing system has advantages of being able to realize a high resolution and a fast printing speed by increasing the density of ink ejection nozzles and to produce a high-quality image at low cost without requiring special processing, such as fixing, on a print medium including plain paper. Because of these advantages, the ink jet printing apparatus are in wide use today. An on-demand type ink jet printing apparatus can easily be upgraded to print color images and easily made compact in size and simple in construction. It is therefore expected to have an increased demand in the future.

The use of the printing apparatus on the part of user has diversified. To meet diversified uses, a printing apparatus has become available which provides a variety of printing modes. One such example is an ink jet printing apparatus with a double-sided printing mechanism that allows for continuous printing on both sides of a print medium.

In the printing apparatus with such a double-sided printing mechanism, a print medium is normally applied with ink on one of its print surfaces (hereinafter referred to as a front surface or first print surface) to form an image and then is turned over before being printed on the other surface (referred to as a back surface or second print surface).

In this double-sided printing apparatus, if, after the front surface has been printed, the print medium is turned over without the ink on the front surface being thoroughly dried, there is a possibility of the print medium starting to be fed and printed before a cockled or waved state of the print medium is eliminated. In that case, the print head may come into sliding contact with the print medium, failing to produce an image of an intended quality. Further, as the print medium is reversed or the back surface is printed, a waved portion of the print medium may get caught in a transport mechanism, causing a jam.

It is therefore desired that, after the printing of the front surface, the ink applied to the print medium be thoroughly dried so that the turning over of the print medium will not result in a jam or a head-medium rubbing. That is, a standby time, or a time it takes from when the front surface printing is finished until the print medium begins to be turned over, should preferably be set considering the time required to dry ink.

As a conventional means for setting the standby time, Japanese Patent Application Publication No. 2879872 discloses a printing apparatus which determines the standby time according to the kind of print medium. Japanese Patent Application Laid-open No. 2003-048311 discloses a printing apparatus which determines the standby time according to a print duty.

In Japanese Patent Application Publication No. 2879872, since the length of standby time is determined by the kind of print medium, equal standby times are set for those print mediums of the same kind even if they are printed at different print duties. Hence, when the print duty is high, the set drying time may be too short for some of the print sheets; and when the print duty is low, too long a drying time may be set, wasting time.

To get around this problem, the printing apparatus in Japanese Patent Application Laid-open No. 2003-048311 determines the standby time according to the print duty. In Japanese Patent Application Laid-open No. 2003-048311, however, since the standby time is determined based on the print duty of the entire surface, equal standby times are set as long as the print duties are equal whatever the distributions of ink quantity applied to the surfaces may be. For example, whether an image formed on the surface is deviated to one side or to the center, the standby times are set equal as long as the overall ink application quantities to one page are the same.

A jam and a head-medium rubbing, based on which the standby time is determined, are likely to occur near the end portions of print medium. Hence, ink applied to near the end portions of print medium needs to be dried sufficiently. On the other hand, it is not necessary to provide much drying time for the ink applied to the central portion.

As described above, since the standby time from the end of the front surface printing to the start of the back surface printing has conventionally been determined simply by the amount of ink applied to the entire surface without taking into account the distribution of ink application amount, the printing time has not been reduced sufficiently. That is, because a long standby time is set even when a large amount of ink is distributed to those parts of a print medium where the ink is not likely to cause such problems as jam and head-medium rubbing, the printing time is unduly long. As demands are growing now for faster printing speed and higher print quality, it is desirable to eliminate an excess, unused portion of the above-described standby time to reduce the printing time while at the same time minimizing the occurrence of jam and head-medium rubbing.

SUMMARY OF THE INVENTION

This invention can overcome the above-mentioned problems of the conventional technique and can provide an ink jet printing apparatus and an ink jet printing method which can prevent a jam and a head-medium rubbing during the double-sided printing and which can shorten the time required for the printing. This invention has the following aspects.

That is, according to a first aspect, the invention provides an ink jet printing apparatus for printing on a first print surface and a second print surface of a print medium successively by using a printing unit for ejecting ink according to print data, the ink jet printing apparatus comprising: a retrieval means for retrieving information on an amount of ink applied to a particular area in the first print surface; a standby time setting means for setting, according to the information on the ink application amount retrieved by the retrieval means, a standby time from when the printing on the first print surface is finished until an operation associated with a printing on the second print surface starts; and control means for starting the operation associated with the printing on the second print surface according to the standby time set by the standby time setting means after the printing on the first print surface is finished.

According to a second aspect, the invention provides an ink jet printing apparatus for printing on a first print surface and a second print surface of a print medium successively by scanning a printing unit for ejecting ink over the print medium, the ink jet printing apparatus comprising: ink application amount retrieval means for retrieving information on an amount of ink applied to a particular area in the first print surface in each scan of the printing unit; standby time setting means for setting in each scan of the printing unit, according to the information on the ink application amount retrieved by the ink application amount information retrieval means, a standby time from when the printing on the first print surface is finished until an operation associated with a printing on the second print surface starts; remaining time calculation means for calculating a remaining time of each standby time by subtracting a time, which has passed from the end of each scan to the end of the printing operation on the first print surface, from each standby time set by the standby time setting means; and a control means for starting the operation associated with the printing on the second print surface according to a longest remaining time calculated by the remaining time calculation means after the printing on the first print surface is finished,.

According to a third aspect, the invention provides an ink jet printing method for printing on a first print surface and a second print surface of a print medium successively by using a printing unit for ejecting ink according to print data, the ink jet printing method comprising: retrieving information on an amount of ink applied to a particular area in the first print surface; setting, according to the information on the ink application amount retrieved by the retrieving step, a standby time from when the printing on the first print surface is finished until an operation associated with a printing on the second print surface starts; and starting the operation associated with the printing on the second print surface according to the standby time set by the setting step after the printing on the first print surface is finished.

According to a fourth aspect, the invention provides an ink jet printing method for printing on a first print surface and a second print surface of a print medium successively by scanning a printing unit over the print medium, the ink jet printing method comprising: retrieving information on an amount of ink applied to a particular area in the first print surface in each scan of the printing unit; setting in each scan of the printing unit, according to the information on the ink application amount retrieved by the retrieving step, a standby time from when the printing on the first print surface is finished until an operation associated with a printing on the second print surface starts; calculating a remaining time of each standby time by subtracting a time, which has passed from the end of each scan to the end of the printing operation on the first print surface, from each standby time set by the setting step; and starting the operation associated with the printing on the second print surface according to a longest remaining time calculated by the calculating step after the printing on the first print surface is finished.

In this specification, the first print surface denotes a first of the two surfaces of a print medium to be printed and is also called a front surface in the following description. The second print surface denotes a surface to be printed after the first print surface has been printed and is also called a back surface in the following description.

With this invention it is possible to substantially reduce a contamination of a print medium and a degradation of image quality caused by a head rubbing and also reduce an occurrence of jam. An overall time required for double-sided printing can also be reduced.

The above and other objects, effects, features and advantages of the present invention will become more apparent from the following description of embodiments thereof taken in conjunction with the accompanying drawings.

BRIEF DESCRIPTION OF THE DRAWINGS

FIG. 10 illustrates an example table used in the first embodiment of this invention, indicating a relation between a range of ink application amount (M) and a length of standby time (T);

FIG. 11 illustrates another example table used in the first embodiment of this invention, indicating a relation between a print medium kind, a range of ink application amount (M) and a length of standby time (T);

DETAILED DESCRIPTION OF PREFERRED EMBODIMENTS

Now, embodiments of this invention will be described in detail by referring to the accompanying drawings.

First Embodiment

Figure 1:
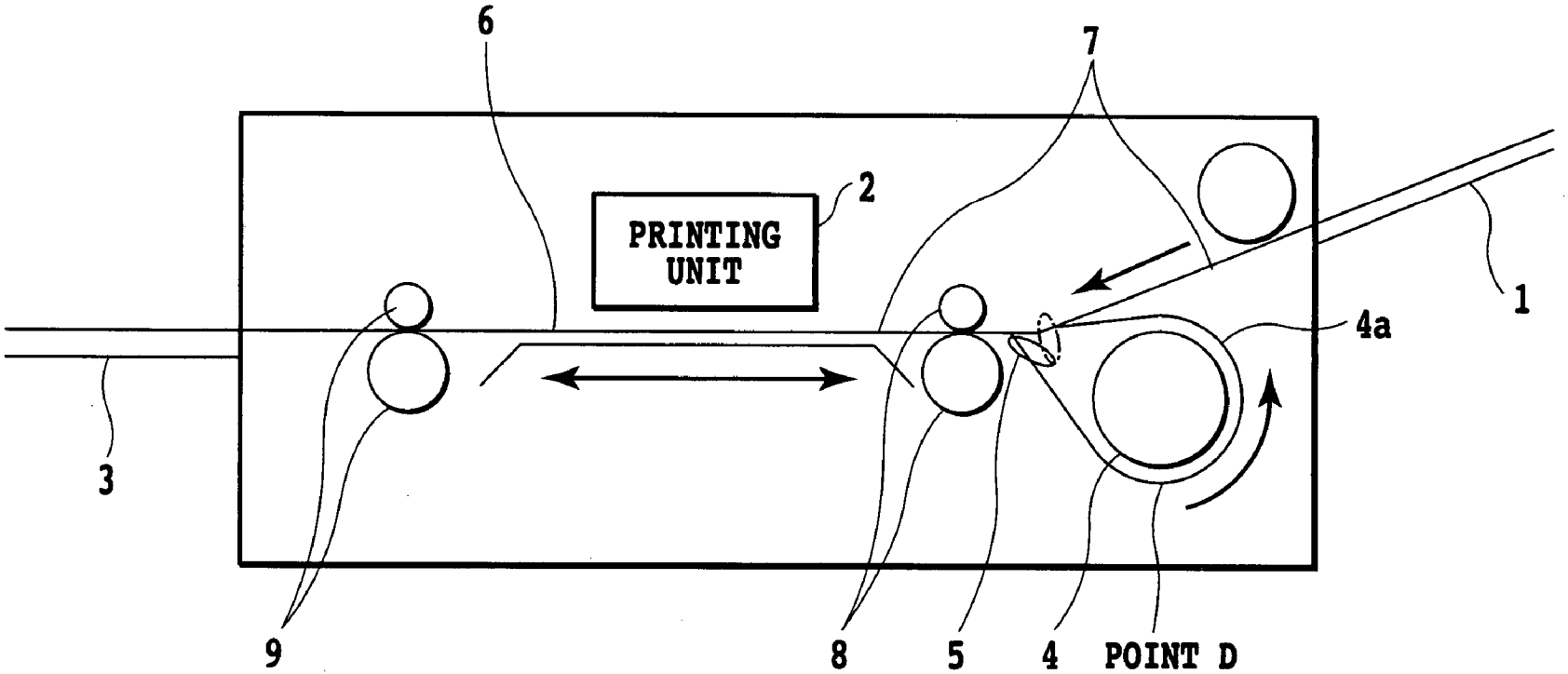
FIG. 1 is an example outline construction of an ink jet printing apparatus applicable to the present invention.

FIG. 1 shows an example outline construction of an ink jet printing apparatus applicable to this invention. The ink jet printing apparatus shown here has a double-sided printing mechanism that allows both sides of a print medium to be printed by turning it over.

In FIG. 1, reference number 1 represents a supply tray (supply unit), 2 a printing unit (printing means), 3 a discharge tray (discharge unit), 4 a reversing mechanism, 5 a switching member, 6 a platen, 7 a transport path, 8 an upstream transport roller pair, and 9 a downstream transport roller pair.

Sheets of a print medium are stacked on the supply tray 1. The print medium is supplied to the transport path 7 one sheet at a time. The print medium thus supplied is held between a pair of transport rollers (pinch roller pair) 8 on the upstream side and, by their forward rotation, transported over the platen 6 in the direction of arrow X1. As the print medium is moved, supported on the platen, the printing unit 2 prints an image on a front end part of the first print surface (front surface). Then, the print medium is held by the upstream transport rollers 8 and the downstream transport rollers 9 (also referred to as discharge rollers). In this state, the printing operation is performed on a normal area of the first print surface (front surface). Lastly, the rear end of the print medium comes off the pinch roller pair 8 and is held by the downstream transport roller pair 9 alone. In this state the printing is done on the rear end part of the first print surface (front surface). The printing on the front surface is completed in this manner. In the case of a one-sided printing, the rotation of the downstream transport roller pair 9 holding the print medium causes the print medium to be discharged onto the discharge tray 3.

In the case of a double-sided printing, after the front surface printing is finished, the print medium is not discharged onto the discharge tray 3. That is, when the front surface printing is complete, the downstream transport roller pair 9 is reversed to feed the print medium back in the direction of arrow X2 to a reversing mechanism 4. At this time if the print medium needs to be dried, it is kept standing by on the platen 6 for a while before being fed to the reversing mechanism 4. The length of time from when the printing on the front surface of the print medium is finished until a series of operations associated with the back surface printing is started, i.e., the length of time until the reversing of the print medium starts, is determined according to the print data on the front surface.

More specifically, the length of time it takes for the ink, applied to those portions of the front surface contributing to a head-medium rubbing and a jam, to be thoroughly fixed (or dried) is determined by considering image data. After the determined time has passed, an operation associated with the back surface printing is started.

After the print medium is dried for the standby time, the print medium reversing operation is initiated. At this time, the switching member 5 is rotated clockwise in the figure to a position indicated by a one-dot chain line where it is held. The print medium that has reached the switching member 5 is transported along a looplike reverse path 4*a* in the reversing mechanism 4. After being transported along the reverse path 4*a*, the print medium comes out upside down with the front and rear side reversed and, in this state, is fed to the printing unit 2. That is, the print medium that has passed through the reverse path 4*a* has its back surface oppose the printing unit 2, with one end portion, which is situated at the rear during the one-sided printing, situated at the front. The print medium turned over in this manner is printed on its back surface by the printing unit 2 before being discharged onto the discharge tray 3.

Figure 2:
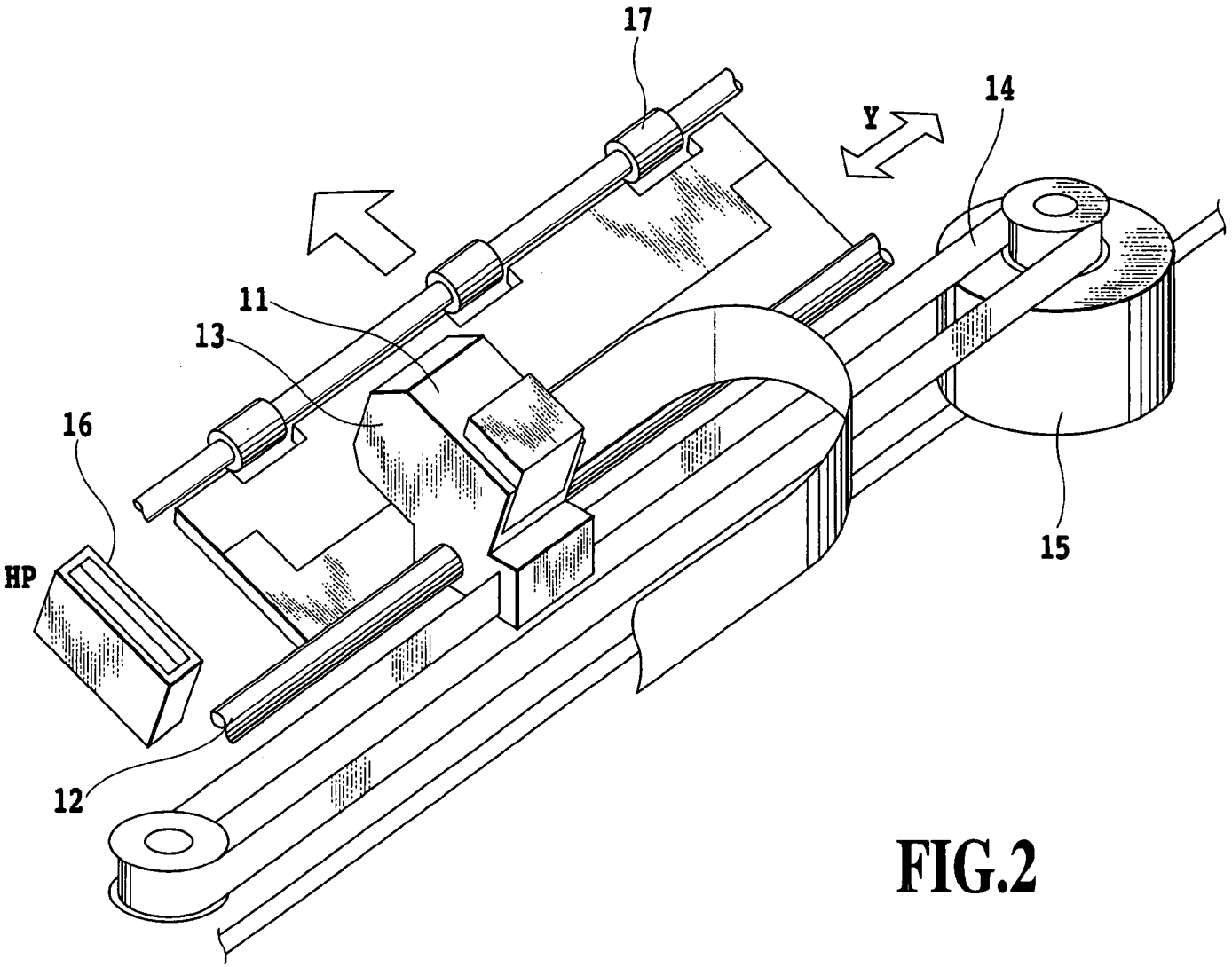
FIG. 2 is a perspective view showing an example construction of components associated with the printing unit shown in FIG. 1.

FIG. 2 is a perspective view showing an example construction of components associated with the printing unit 2 of FIG. 1.

A print head 11 having a column of nozzles for ejecting ink is installed in a carriage 13. A print medium such as plain paper and OHP sheet is fed by the upstream transport rollers 8 (not shown) and then gripped by discharge rollers 17 that are driven by a transport motor not shown to feed the print medium in the direction of arrow. The carriage 13 is guided and supported by a guide shaft 12 and an encoder (not shown). The carriage 13 is reciprocally moved along the guide shaft 12 in the direction of arrow Y in the figure by a carriage motor 15 through a drive belt 14.

The print head 11 is an ink jet print head that ejects ink to form an image. In inner ink paths of the print head there are provided heater elements (electrothermal transducers) that generate thermal energy for ink ejection (this construction will be detailed later in connection with FIG. 3 and FIG. 4). Each of these heater elements is energized based on a print signal at a read timing of the encoder (not shown) to eject an ink droplet to land on the print medium, forming an image on the print medium.

Outside an area having the largest width among the areas where the printing operation is performed by the print head 11, there is set a home position. At this home position a recovery unit with a cap member 16 is installed. When a printing operation is not performed, the carriage 13 is moved to the home position where the ink ejection nozzle forming face of the print head 11 is hermetically closed by the cap member 16. Hermetically closing the ink ejection nozzle forming face with the cap member can forestall a possible clogging of nozzles caused by solidifying of ink due to evaporation of ink solvent or by adhesion of paper dust and other foreign matters to the ink ejection nozzle forming face.

The cap member 16 is also used to eliminate ejection failures and clogging of nozzles with a low operation frequency that are caused by increased viscosity and solidifying of ink in these nozzles. For example, in a preliminary ejection mode in which ink is ejected from the nozzles with a low operation frequency, the cap member 16 may be used to receive the ejected ink. The cap member may also be used to execute a suction operation mode in which, with the cap closed, a pump not shown is activated to forcibly draw out ink from nozzles by suction to recover the ink ejection function of the failed nozzles. Further, by installing a blade close to the cap member 16 it is possible to clean the ink ejection nozzle forming face of the ink jet print head.

Figure 3:
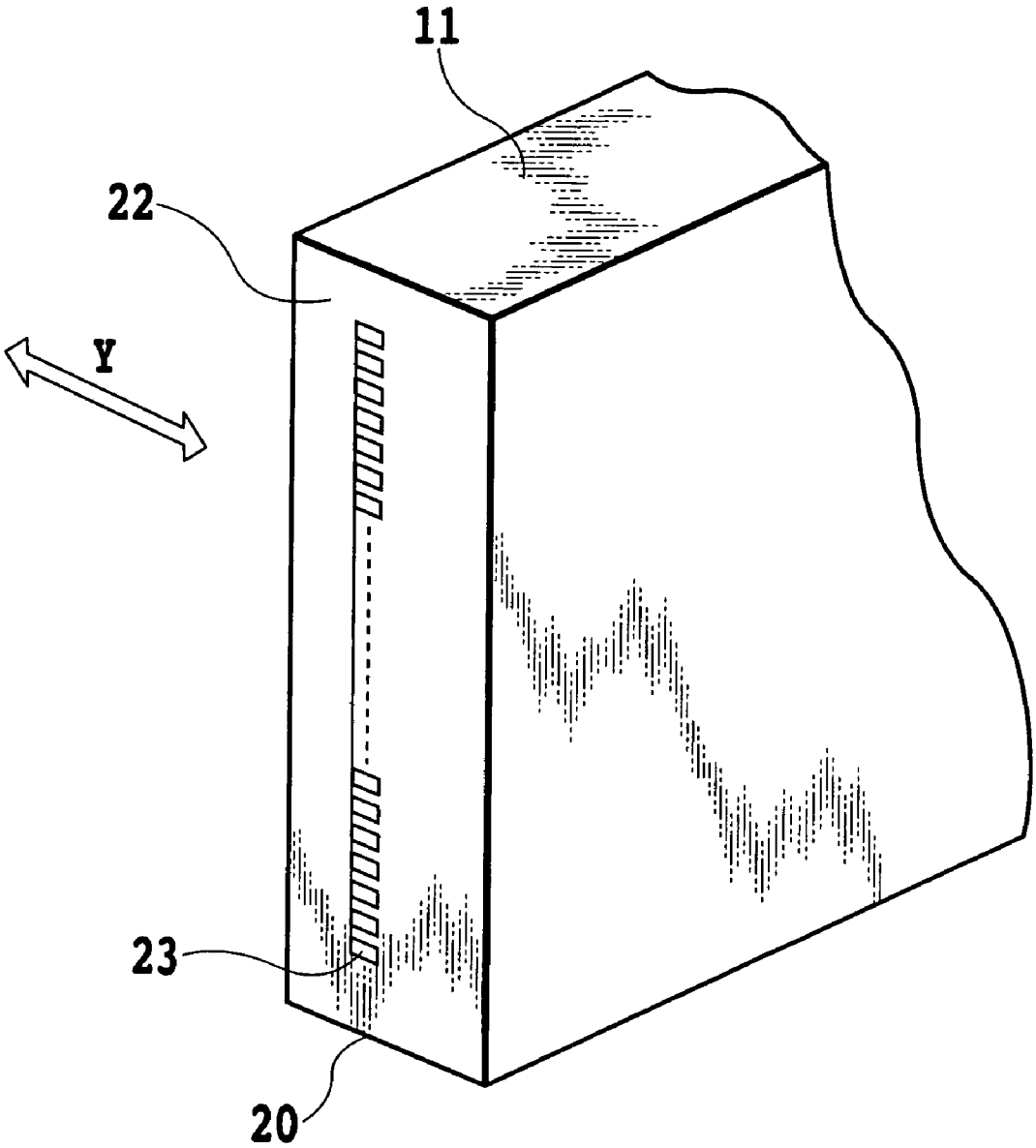
FIG. 3 is a schematic perspective view showing a array of ink ejection nozzles in an ink ejection unit of the print head as seen from a print medium side.
Figure 4:
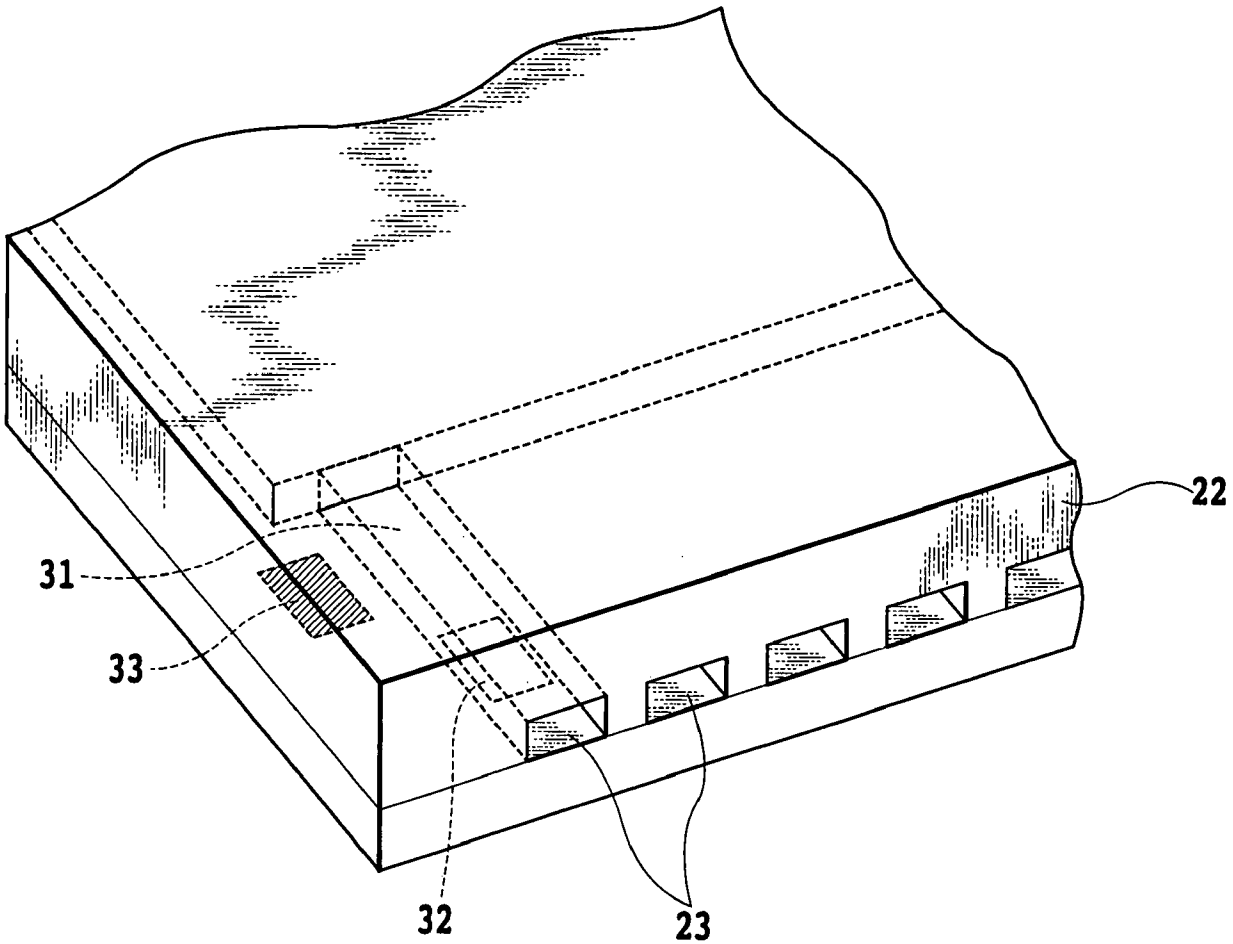
FIG. 4 is a partial perspective view schematically showing an inner construction of the ink ejection unit of the print head.

FIG. 3 is a perspective view schematically showing a column of nozzles in the ink ejection unit of the print head 11 as seen from the print medium side; and FIG. 4 is a partial perspective view showing an inner structure of the ink ejection unit. This ink ejection unit has a nozzle face 22 having a plurality of ink ejection nozzles 23 formed therein. Each of the nozzles 23 communicates with an ink path 31 in which is provided an ejection energy generation element 32 that produces energy required to eject ink. Arrow Y in FIG. 3 represents a direction in which the carriage 13 is scanned.

Denoted 33 in FIG. 4 is a temperature sensor to detect a temperature of the print head 11. In this embodiment, a thermistor as the temperature sensor is provided at each end of the nozzle array. It is noted, however, that a means to detect temperature is not limited to this example and that other sensors such as diode sensor may be used. It is also possible to use a means that calculates a head temperature from a dot printing duty.

While the above embodiment of this invention uses a thermal energy to eject ink as shown in FIG. 4, this embodiment is not limited to this printing method. For example, in the case of an on-demand type, a pressure control system may be used which ejects ink droplets from orifices (nozzles) by mechanical vibrations of piezoelectric oscillation elements. Or in the case of a continuous type, an electric charge control system and a diffusion control system may be applied.

Figure 5:
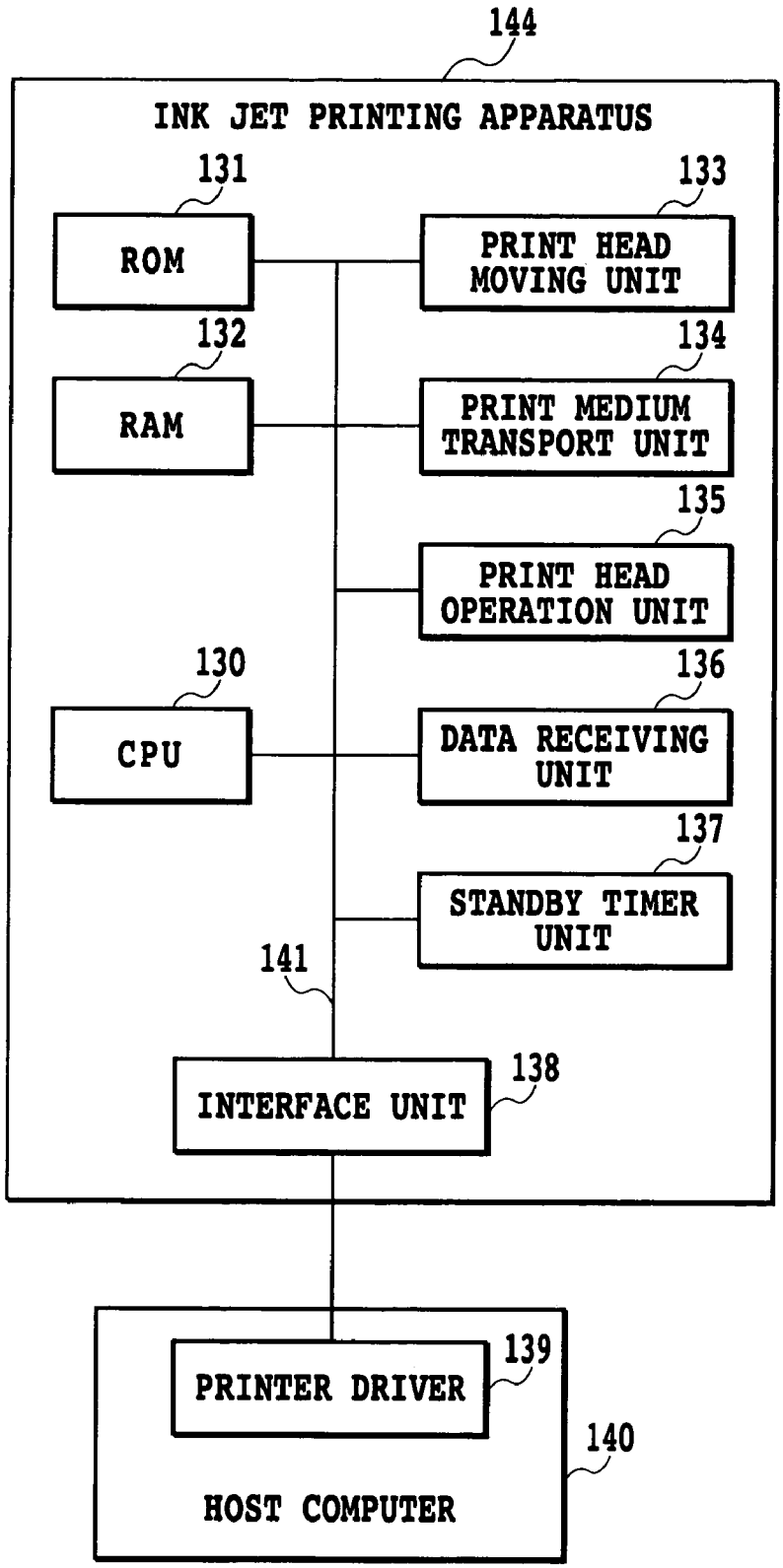
FIG. 5 is a block diagram showing a schematic configuration of a control system of the ink jet printing apparatus according to the embodiment of this invention.

FIG. 5 is a block diagram showing an outline configuration of a control system used in the ink jet printing apparatus of this embodiment.

In FIG. 5, designated 130 is a CPU that controls the operations of various components in the ink jet printing apparatus and which has a function of executing processing to be described later, such as calculation, decision and control. Denoted 131 is a ROM which stores control programs executed by the CPU 130; and 132 represents a RAM to store data being processed by the CPU 130 and input data.

The CPU 130, ROM 131 and RAM 132 are connected through a data bus 141 with a print head moving unit 133, a print medium transport unit 134, a print head operation unit 135, a data receiving unit 136, a standby timer unit 137, an interface unit 138 and others. The interface unit 138 is also connected with a host computer 140, which has a printer driver 139 installed therein.

The print information sent from the host computer 140 through the printer driver 139 is received via the interface unit 138 by the data receiving unit 136 in the ink jet printing apparatus. The data receiving unit 136 receives data according to the state of the ink jet printing apparatus and transfers the received data to the RAM 132. According to a print instruction from the host computer 140, the CPU 130 controls the print head moving unit 133, the print medium transport unit 134 and the print head operation unit 135.

FIG. 5 will be explained in more detail. The CPU 130 reads programs and various data from the ROM 131 and RAM 132, performs necessary calculations and decisions, and outputs various control signals according to the control programs to control the overall operation of the printing apparatus. The ROM 131 is a program memory and stores a variety of programs and data for use by the CPU 130. The RAM 132 is a buffer memory and includes a working area in which the CPU 130 can temporarily store data contained in an instruction and calculation results, and a text area in which to store a variety of data. The CPU 130 is connected through the data bus 141 with the standby timer unit 137 which performs clocking, triggered by an instruction signal from the CPU 130, and outputs time information.

The CPU 130 is electrically connected with the host computer 140 through the interface unit 138. The CPU 130 controls the printing operation based on image data (print data) from the host computer 140 stored in the ROM 131 and RAM 132. The host computer 140 has the printer driver 139 which receives print information created and edited by the computer and transfers the print information to the ink jet printing apparatus 144 through the interface unit 138. The printer driver 139 allows for setting and selection of various information associated with the printing operation of the printing apparatus, and information set or selected here can be transferred to the printing apparatus 144 side.

Among various information associated with printing there are information representing the kind of print medium, such as plain paper and OHP sheet, and selection information to select between the one-sided print mode and the double-sided print mode. In addition to controlling the print head moving unit 133 and the print medium transport unit 134, the CPU 130 also controls the printing unit 2 (print head 11) through the print head operation unit 135, based on print information stored in the RAM 132. An operation panel to set print information such as print mode and a sheet sensor (not shown) to detect the front and rear edges of the print sheet are connected to the CPU 130 through data bus.

Figure 6:
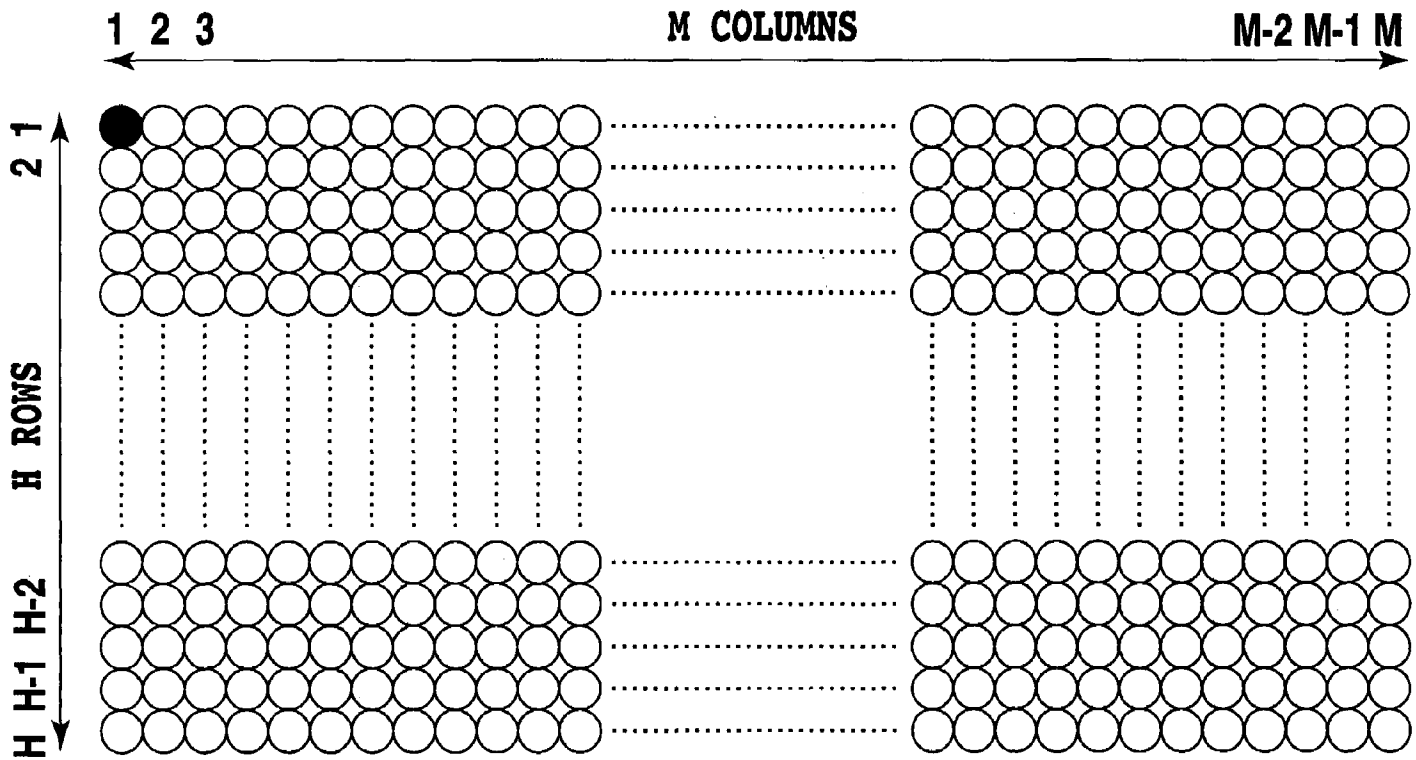
FIG. 6 is an explanatory diagram showing how print data for front surface printing is stored in a buffer memory in the embodiment of this invention.
Figure 7:
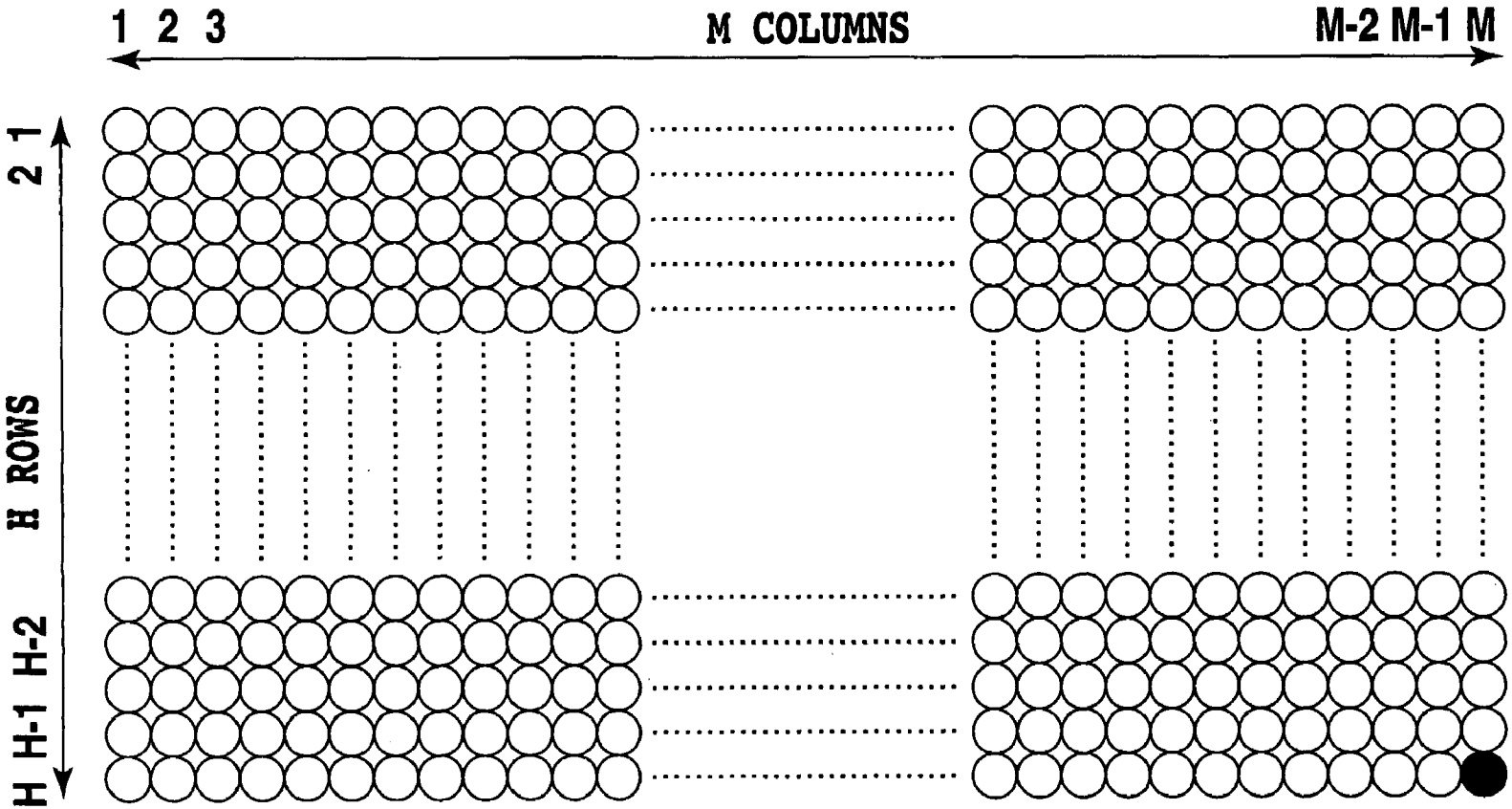
FIG. 7 is an explanatory diagram showing how print data for back surface printing is stored in a buffer memory in the embodiment of this invention.

The RAM 132 as a buffer memory has a function of a line buffer storing print data for one or more scans. This line buffer stores information indicating which orifices of the print head will print at which positions in a print area in one main scan of the print head. FIG. 6 and FIG. 7 show how print data is stored in the buffer in the RAM 132.

The buffer comprises M columns and H rows, the M columns at a predetermined dot pitch representing a maximum print width of a sheet available in the ink jet printing apparatus 144, the H rows corresponding to the number of orifices in the print head. The print data sent from the host computer 140 and expanded is stored in the buffer beginning with a dot of first row and first column (a dot painted black) as shown in FIG. 6 when the front surface of the sheet is printed. When the back surface is printed, the print data begins to be stored in the buffer from a dot of H-th row and M-th column (a dot painted black) as shown in FIG. 7. This is because, during the back surface printing, the print medium is fed to the print head 11 with the front and rear ends reversed. The print data storing order for the back surface may be set equal to that for the front surface as shown in FIG. 6 but, when the print data is sent from the printer driver 139 to the ink jet printing apparatus 144, the order of sending the print data may be reversed. The dots shown in FIG. 6 and FIG. 7 schematically represent dots to be expanded and printed on a print sheet but are not necessarily handled such that each dot represents one piece of print data.

Next, the operation to be executed by the ink jet printing apparatus of the above construction during the double-sided print mode will be explained. The print data to be stored in the line buffer (RAM 132) of the ink jet printing apparatus is the data that has undergone predetermined processing for double-sided printing in the printer driver 139 of the host computer 140.

Figure 8:
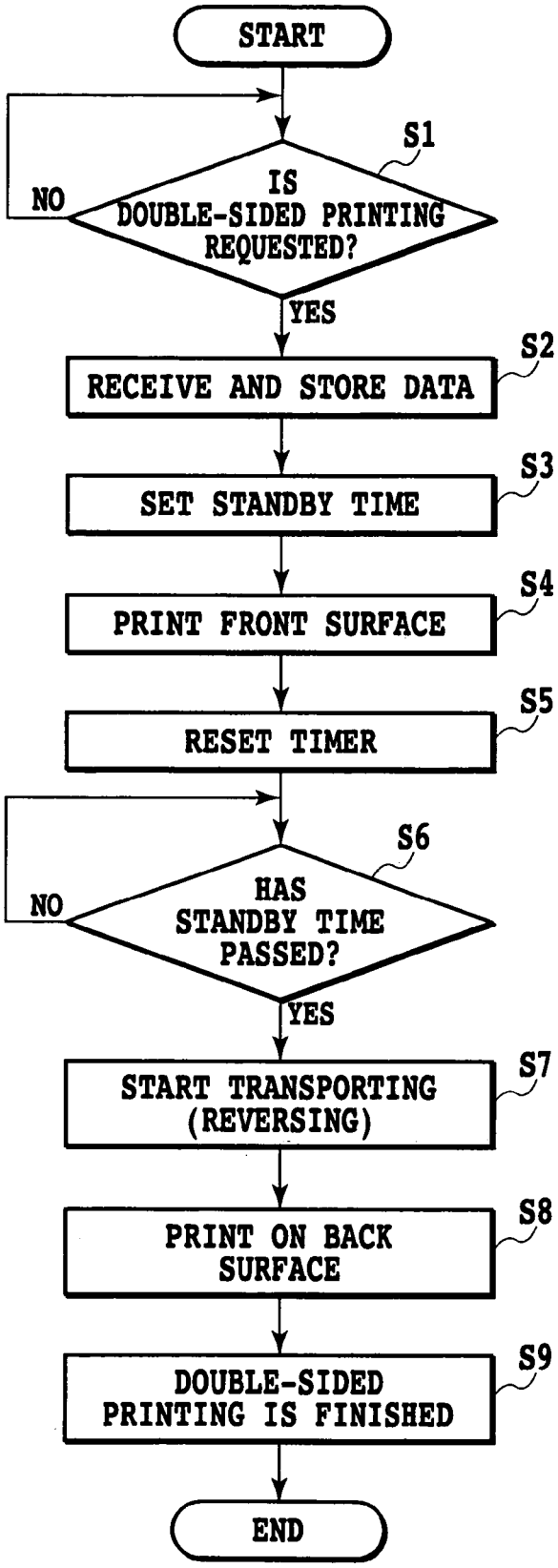
FIG. 8 is a flow chart showing a printing procedure during a double-sided print mode.

FIG. 8 is a flow chart showing a sequence of operations to be performed during the double-sided print mode.

First, in step S1 a decision is made as to whether a print start instruction has been received from the host computer 140. If the print start instruction is found to be received, the next step receives print data sent from the printer driver 139 of the host computer 140 and stores them in the buffer of RAM 132. Step S3, based on the stored print data, calculates and sets (determines) the length of time (standby time) from when the printing on the front surface of a print medium (first print surface) is finished until operations associated with the printing on the back surface (second print surface) (e.g., reversing of the print medium) begin.

Here, the standby time is determined according to the print data used to print the front surface of the print medium (first print surface). More specifically, only those particular areas where jam and head-medium rubbing are highly likely to occur during the back surface (second print surface)

printing are picked up as ink application quantity check areas. Then, the amount of ink applied to these ink application quantity check areas (total amount of ink applied) during the front surface printing is calculated based on the print data that matches the above particular areas.

Although this embodiment converts the number of dots printed in the particular check areas into the ink application quantity and compares it with a threshold to determine the standby time, other methods may be employed. In this invention, the ink application quantity in the particular check areas needs only to be determined directly or indirectly. For example, one possible method may involve detecting the number of dots to be printed in the particular check areas without converting it into the ink application quantity and comparing it with a threshold to determine the standby time. In this case, the threshold is of course defined in the number of dots.

In essence, the information to be compared with the threshold need only to be information directly or indirectly associated with the amount of ink applied to the particular check areas. For example, information on the ink application quantity itself (a value converted into the ink application quantity) may be used as in this embodiment or information indirectly related to the ink application quantity (for example, the number of dots to be printed and a print duty) may be used. Either information can be applied to this invention. As described above, in determining the standby time, this invention requires the use of information associated with the amount of ink applied to the particular check areas.

Figure 9:
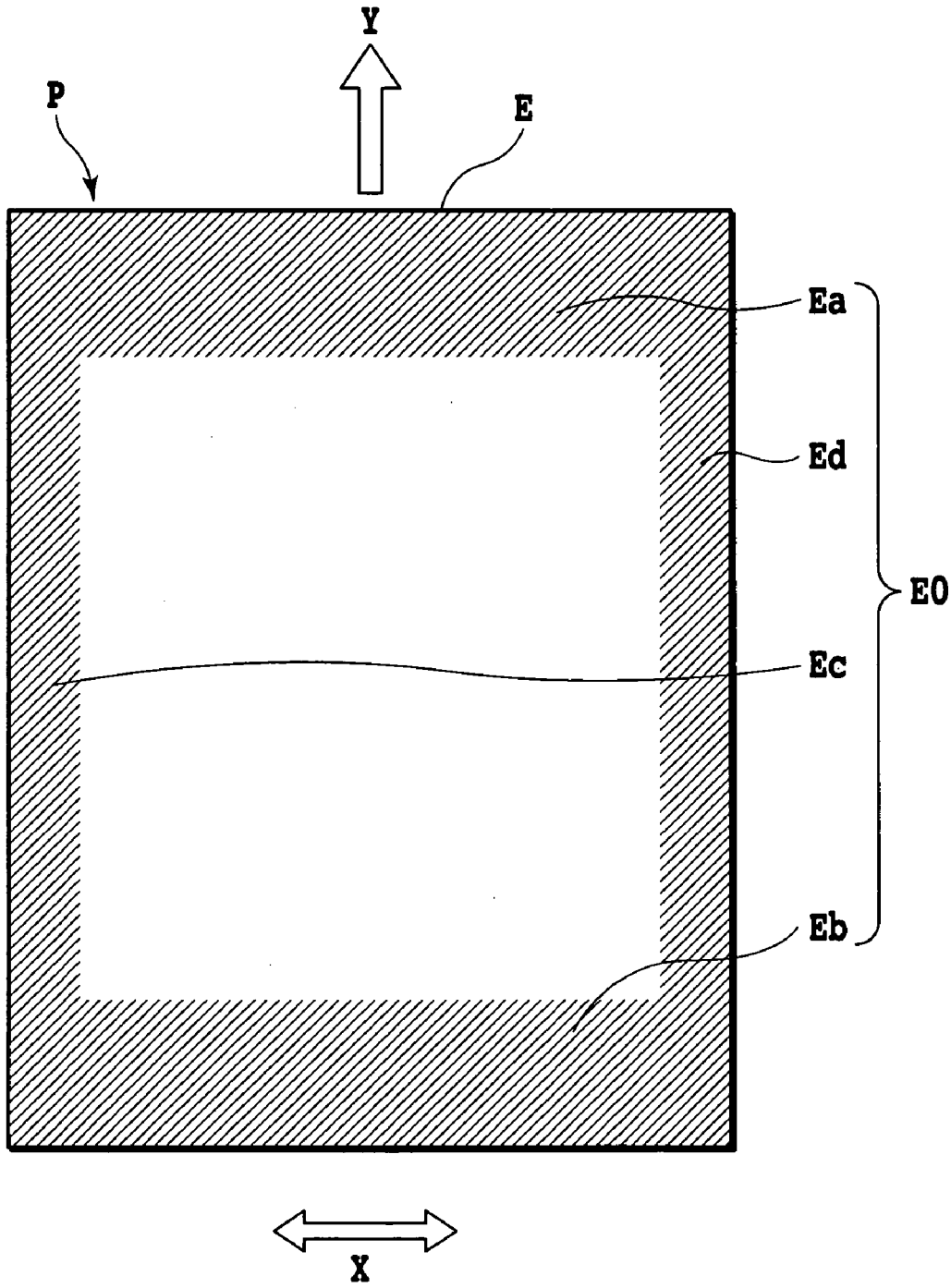
FIG. 9 is an explanatory diagram showing an example of position and shape of an area in a print medium to be checked that is set in the embodiment of this invention.

FIG. 9 shows one example of the position and shape of check areas to be set in this embodiment.

When a back surface is printed during the double-sided printing, problems such as jam and head-medium rubbing are likely to occur in a frame area E0 along edge portions of a back surface E of the print medium P. In particular, an area Ea along the front end of the print medium P and an area Eb along the rear end are more likely to result in the above problems. Of the above areas, those that cannot be transported using the two roller pairs—a roller pair situated upstream of the print head 11 (transport roller pair 8) and a downstream roller pair (discharge roller pair 9)—are problematic areas where the above problems are most likely to occur (i.e., the front end area and rear end area described above) because if the print medium is transported by only one roller pair, it is highly likely that the print medium will float.

The jam and head-medium rubbing may also occur in areas Ec, Ed at the front and rear end in the direction of carriage scan (X direction) (namely, left and right side with respect to the print medium transport direction Y). If the areas Ec, Ed float, the end portions of the print head 11 may strike the ends of the areas Ec, Ed or contact the nozzle face 22 of the print head 11 (see FIG. 4) as the carriage 13 reciprocally moves over the print medium many times for printing (see FIG. 2). Thus, if the total amount of ink applied to these areas E0 is large, it is essential that the standby time be set long enough to thoroughly fix and dry ink and eliminate a waved state that occurs with the end portions of the print medium.

Therefore, in this embodiment, after the total amount of ink applied to the check area E is calculated, the standby time from the end of the front surface printing to the start of the transport operation for back surface printing (reverse transport of print medium) is determined based on the calculated ink application quantity. For example, when the ink application amount is a first application quantity, the standby time is set to a first standby time; and when the ink application amount is a second application quantity which is greater than the first application quantity, the standby time is set to a second standby time which is longer than the first standby time. That is, the greater the ink application quantity, the longer the standby time; and the smaller the ink application quantity, the shorter the standby time.

This is explained by referring to FIG. 8. With the standby time set as described above, step S4 feeds a print medium from the supply tray 1 and performs printing on the front surface. Next, step S5 sets the standby time determined by step S3 in the timer. After this, at step S6 a check is made to see if the set standby time has passed from the end of the front surface printing. The operation associated with the back surface printing is kept standing by until the set standby time passes. When the standby time passes, the print medium transport operation (reverse transport) for back surface printing is initiated (step S7). Then, when the print medium moves past the reversing path R10 and reaches the printing unit 2, the printing unit 2 prints on the back surface of the print medium (step S8). When the back surface printing is complete, the print medium is discharged onto the discharge tray (discharge unit) 3 by the continuous operation of the discharge rollers 9. Now, the double-sided printing is complete (step S9).

In the first embodiment as described above, the standby time from when the printing operation on the front surface (first print surface) of a print medium is finished until the operation associated with the back surface (second print surface) printing is started is determined according to the print data defining an image to be printed in the area E0 set in the front surface of the print medium.

During the standby time, the rear end portion of the print medium, i.e., the end on the side of the printing unit 2, is held standing by on the platen 6. After the standby time has passed, the discharge rollers 9 are reversed to immediately start the reverse transport operation for the back surface printing.

In the above embodiment, an example case has been described in which the CPU 130 executes a calculation that sets a longer standby time as the ink application quantity increases. It is also possible to adopt a method which involves storing a preset relation between the standby time (T) and the ink application quantity (M) in a standby time determination table in advance, and reading an appropriate relation from the table to determine the standby time. For example, a table may be prepared which matches a range of ink application quantity (M)—$0 \leqq M < m1$, $m1 \leqq M < m2$, $m2 \leqq M < m3$, and $m3 \leqq M$ ($0 < m1 < m2 < m3$)—with the length of time (T)—$T = t1$, $T = t2$, $T = t3$ and $T = t4$ ($t1 < t2 < t3 < t4$)—as shown in FIG. 10 and the table is referenced to determine the standby time. That is, if the ink application quantity (M) falls in the range of $0 \leqq M < m1$, the length of time (T) is set to t1; if the ink application quantity (M) falls in the range of $1 \leqq M < m2$, the length of time (T) is set to t2; if the ink application quantity (M) is in the range of $m2 \leqq M < m3$, the length of time (T) is set to t3; and if the ink application quantity (M) is in the range of $m3 \leqq M$, the length of time (T) is set to t4.

Although the standby time (T) has been described to be determined by calculating the amount of ink applied to the check area E based on the image data, the present invention is not limited to this method.

Elements that determine the standby time (T) may include the kind of print medium as well as the ink application quantity (image data). In that case, a relation between the standby time (T), the ink application quantity (M) and the kind of print medium may be stored in the form of a standby time determination table in advance and an appropriate standby time (T) chosen from the table.

An example of this table is shown in FIG. 11. By using such a table, it is also possible to take into account an ink absorption characteristic that depends on the kind of print medium, for example, an amount of deflection of print medium when applied with ink or a time it takes for the deflections to be eliminated. This method allows for the selection of a standby time (T) more suited to the characteristic of individual print mediums. Compared with Japanese Patent Publication No. 2879872 which determines the standby time (T) according to the kind of print medium alone, this embodiment considering the ink application quantity as well can set a more appropriate time.

In this embodiment while the standby time setting is done by the printing apparatus, this invention is not limited to this configuration. That is, the processing of standby time setting may be executed by the printer driver and the standby time data thus obtained may be transmitted along with the print data.

As described above, in the first embodiment, only those areas in the front surface of the print medium where jam and head-medium rubbing are likely to occur (particular areas) are picked up as a check area E0 according to the print data used for printing on the front surface of the print medium. Then, the amount of ink to be applied to the check area E0 is calculated, the standby time is determined based on the ink application quantity and, after the standby time passes, the operation associated with the back surface printing to be performed next is initiated. Therefore, compared with Japanese Patent Application Laid-open No. 2003-048311 which determines the standby time based on the amount of ink applied to the whole area of the front surface of the print medium, this embodiment can reliably reduce troubles such as jam and head-medium rubbing. Further, even if a large amount of ink is applied to other than the check area of the front surface, an excess standby time that may result from the large ink application quantity can be prevented. That is, after the actually required standby time has passed, the operation associated with the next back surface printing is immediately started. So, the overall printing time during the double-sided printing can be reduced.

Second Embodiment

Next, a second embodiment of this invention will be described.

In the second embodiment, the ink application quantity check area that is set in the print medium front surface is divided into two or more areas and a standby time is set for each divided area.

In other respects this embodiment is similar in construction to the first embodiment, so their explanations are omitted. That is, in the second embodiment only the time setting method in step S3 of FIG. 8 differs from the first embodiment with other steps executed in the same way as in the first embodiment.

Figures 12A, 12B:
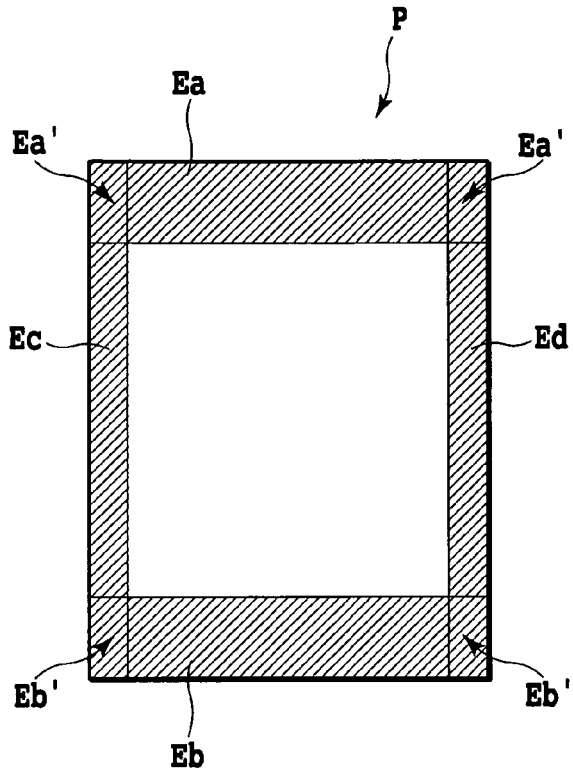
FIG. 12A is an explanatory diagram showing an area to be checked that is set in a print medium in a second embodiment of this invention.
FIG. 12B illustrates an example table indicating a relation between an amount of ink applied to a particular position in a print medium (M) and a length of standby time (T) in the second embodiment of this invention.

FIG. 12A shows an example in which the ink application quantity check area E0 of FIG. 9 is divided according to the level of possibility (or risk) of occurrence of head-medium rubbing. FIG. 12B illustrates a table that gives a standby time for each range of ink application quantity in each divided area.

In FIG. 12A, compared with the area Ea along the front end portion of the print medium P and the area Eb along the rear end portion, the area Ec along the left side portion and the area Ed along the right side portion have small deflections (distances they float) when applied with ink. Thus, the standby times tc1-tc4, td1-td4 for the areas Ec, Ed are set shorter than those ta1-ta4, tb1-tb4 for the areas Ea, Eb in various ink application quantity ranges. Further, four corners of the print medium P, (Ea', Eb'), are most likely to float by deflection and therefore result in the head-medium rubbing and jam. Therefore, the standby times ta'1-ta'4, tb'1-tb'4 for the corner areas are set the longest in various ink application quantity ranges.

As described above, this embodiment divides the check area, where head-medium rubbing and jam are likely to occur, into smaller areas according to the level of possibility of occurrence of such troubles and sets standby times in multiple ranges of ink application quantity for each of the divided areas. Once the ink application quantity is determined for each divided area based on the print data, a standby time suited for each of the divided areas is read out according to their ink application quantities. Further, the longest of the standby times read out is selected and, based on the longest standby time, the operation associated with the back surface printing is initiated.

For example, if uniform ink quantities are applied to the check areas, a standby time set for the divided area Ea' (or Eb') where the floating distance will be largest is chosen.

Suppose a large amount of ink, m3 ≦M, is applied to the divided area Ec (or Ed) where the floating distance is relatively small and that a small amount of ink, 0≦M≦m1, is applied to the divided area Ea' (or Eb') where the floating distance is large. In this case, a standby time read out from the table of FIG. 12B for the divided area Ec (or Ed) is tc4 (or td4), and a standby time for the divided area Ea' (or Eb') is ta'1 (or tb'1). Whichever of these standby times, tc4 (or td4) and ta'1 (or tb'1), is longer is chosen as the final standby time.

With the above process taken, an ink contamination can be more reliably prevented and an unduly long standby time eliminated more precisely, making it possible to reduce an overall printing time during the double-sided printing.

Third Embodiment

Next, a third embodiment of this invention will be described by referring to FIG. 13.

In the first embodiment, before the front surface printing operation is initiated, a standby time is set according to image data in the ink application quantity check area E0. In the third embodiment, during the printing operation on the front surface of a print medium, a total amount of ink applied to the check area E0 is detected to determine a standby time each time the carriage 13 and the print head 11 are scanned. Other operations are similar to those of the first embodiment and their explanations are omitted here. In the third embodiment, therefore, only the setting method from step S3 to S5 in FIG. 8 differs from the first embodiment and other steps are executed in ways similar to those of the first embodiment.

The process of setting a standby time in this embodiment will be explained for an example case where the front surface of a print medium is printed in eight scans of the print head 11.

Figures 13A, 13B:
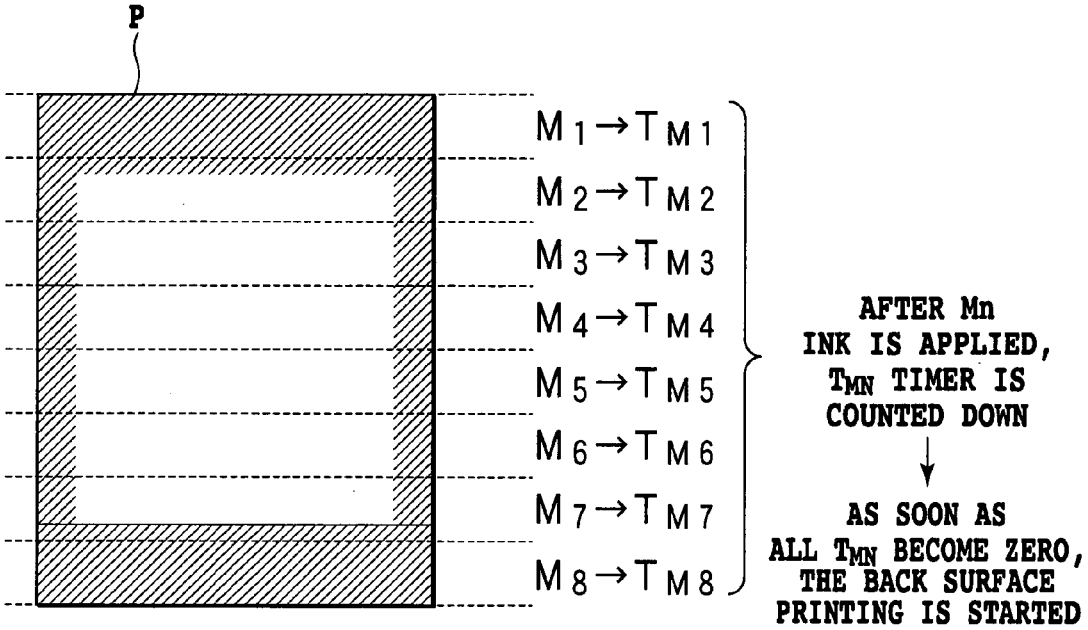
FIG. 13A is an explanatory diagram showing an area to be checked that is set in a print medium and a printing scan area in a third embodiment of this invention.
FIG. 13B illustrates an example table indicating a relation between an amount of ink applied to a print medium in each carriage scan (M) and a length of standby time (T) in the third embodiment of this invention.

In FIG. 13A, the print head is scanned over each of sections of print medium separated by dashed lines and, in each scan, a total amount of ink applied to a check area (shown shaded in the figure), where head-medium rubbing and jam are highly likely to occur, is calculated. Based on the calculated value, a standby time is determined.

The print medium sections separated by dashed lines are each applied with ink by a single scan of the carriage 13 (hereinafter called scan regions). First, an amount of ink applied to the check area in a first scan region, $M_1$, is measured. Since the whole area of the first scan region falls into the check area, the total amount of ink applied to this region is calculated as $M_1$. Then, from the table of FIG. 13B, a standby time $T_{M1}$ until the operation associated with the back surface printing is initiated is determined. The standby time thus determined is set in a timer at the end of the first carriage scan. At the same time, the timer is started to count down the standby time $T_{M1}$.

Next, of the total amount of ink applied to a second scan region during a second carriage scan, an amount applied to the check area, $M_2$, is measured. A front end part, a left end part and a right end part of the second scan region that fall into the check area are specified for the calculation of an ink application amount. A total amount of ink applied to these specified areas is calculated as $M_2$. Then, from the table of FIG. 13B, a standby time $T_{M2}$ up to the start of the back surface printing is determined. The standby time $T_{M2}$ is set in the timer at the end of the second carriage scan, and at the same time the timer is started to count down the standby time $T_{M2}$.

This operation is repeated eight times, after which the printing on the front surface of the print medium is ended. At this time, remaining times of $T_{M1}$ to $T_{M8}$ are checked and the longest remaining time is set as the standby time until the back surface printing can be started.

Here, let us consider a printing pattern in which a large volume of ink is applied to the check area along the front end of the front surface of the print medium and in which a small volume of ink is applied to the check area along the left, right and rear end of the front surface. In this case, $T_{M1}$ and $T_{M2}$ are set with long standby times and $T_{M3}$ and subsequent standby times are set with short lengths of time (or no standby time). The countdown is started for $T_{M1}$ and $T_{M2}$ at the end of the carriage scan, so that by the time the front surface printing is completed, the maximum values of the standby times $T_{Mn}$ (n is 1-8) have become smaller (or zero).

As described above, the third embodiment sets a preliminary standby time that matches the amount of ink applied to the check area in each scan region, calculates an standby time for each scan region by subtracting the time required to finish the front surface printing from the standby time, and then sets the longest of the standby times as a final standby time. That is, ink starts drying immediately after it is applied to the print medium, so that the time spent printing on the front surface is considered to be a part of the standby time. This enables the setting of a standby time with little extra time which suitably matches a real dry state of the applied ink. This in turn allows the back surface printing to be initiated more quickly, reducing the overall time required by the double-sided printing.

Compared with the first and second embodiment, the third embodiment can reduce a range of print data that is referenced at one time and therefore minimize the consumption of memory. This in turn enhances the processing speed and throughput of the printing apparatus. Further, the amount of memory required in the printing apparatus can be minimized, reducing the overall cost of the printing apparatus.

Although in this embodiment the front surface printing has been described to be completed in eight carriage scans, the number of carriage scans may be otherwise. This embodiment can also be applied where the print head is scanned two or more times over the same scan area to form an image.

It is also possible to divide the check area set in the front surface of a print medium into a plurality of smaller areas and to set a standby time for each divided area.

Other Embodiments

In the above embodiments, during the standby time the print medium is kept standing by on the platen 6, with the length of standby time controlled according to the amount of ink applied to the check area. It is noted, however, that this invention is not limited to the above embodiments. For example, the print medium may be made to stand by in the transport path other than the platen 6. Alternatively, a plurality of transport paths may be provided in the ink jet printing apparatus and a desired length of transport path may be selected to control the standby time. It is also possible to make the transport speed of a print medium variable and thereby control the standby time.

Where the print medium is made to stand by on the platen 6, there is no need to hold the print medium at a position where the front surface printing is completed. For example, after the front surface printing is finished, the pinch roller pair may be retracted from the print medium so that the print medium can be moved backward to a position where it opposes the pinch roller pair. At this position the print medium may be made to stand by.

In the above embodiments, although the check area is formed like a closed frame extending along the front, rear, left and right end portions of the print medium, it may be set at two or more separate locations on the print medium. Further, the check area may be set along the front end or rear end of the print medium. In that case, the similar processing to those of the second or third embodiment can be executed.

This invention may also be implemented by directly or remotely supplying software programs, that realize the functions of the above embodiments, to a host computer or an ink jet printing apparatus, and by having the host computer or a control unit of the ink jet printing apparatus (or CPU and MPU) read program codes stored in a storage media and execute them. Therefore, the program codes themselves, that are installed in the computer to realize the above functions, constitute this invention.

Storage media to store such program codes may include floppy (registered trademark) disks, hard disks, optical disks, magnetooptical disks, CD-ROMs, CD-Rs, magnetic tapes, nonvolatile memory cards, and ROMs.

Another method of supplying programs involves, for example, connecting to a home page on the Internet by using a browser of a client computer and then downloading the computer programs themselves of this invention or a file, which is compactioned and has an automatic install function, from the home page into storage media, such as hard disks. It is also possible to divide the program codes making up a program of this invention into a plurality of files and download the individual files from different home pages. In other words, WWW servers that allow program files realizing the functions of this invention in a computer to be downloaded to a plurality of users is also included in the scope of this invention.

It is obvious that not only are the functions of the above embodiments implemented by executing the program codes read out by the computer, but they can also be realized by having an operating system running on the computer execute part or all of actual processing based on the instructions of the program codes.

Also included in this invention is an arrangement in which the program codes read out from a storage media are stored in a memory mounted on a function extension board inserted in a computer or on a function extension unit connected to the computer and in which a CPU provided in the function extension board or in the function extension unit executes a part or all of processing according to instructions from the program codes to realize the functions of the above embodiments.

What has been described above is not limited to a serial printing system and this invention can be effectively applied to a full-line type print head having a length equal to the maximum printable width over which a print medium can be printed by the printing apparatus. Such a full-line type print head may be realized by combining a plurality of print heads or by using a single integrally formed print head.

In the above embodiments electrothermal transducers such as heaters are incorporated in the print head as ejection energy generation elements. This invention is also applicable to an ink jet printing apparatus which uses a print head incorporating electromechanical transducers, such as piezoelectric elements, as the ejection energy generation elements. In this arrangement also, the invention can be expected to produce the similar effect.

As for the kind and the number of print heads mounted in the printing apparatus, two or more of the print heads may be used to accommodate a plurality of inks with different colors and densities. That is, this invention is also very effectively applied to a printing apparatus which, in addition to a print mode using only a main color such as black, has a composite color print mode using different colors or a full color print mode based on color mixing, with the print heads either formed integral as one piece or combined together.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-173076 filed Jun. 10, 2004, which is hereby incorporated by reference herein.

What is claimed is:

1. An ink jet printing apparatus for printing on a first print surface and a second print surface of a print medium successively by using a printing unit for ejecting ink according to print data, the ink jet printing apparatus comprising:

retrieval means for retrieving information on an amount of ink applied to a particular area in the first print surface;

standby time setting means for setting, according to the information on the ink application amount retrieved by the retrieval means, a standby time from when the printing on the first print surface is finished until an operation associated with a printing on the second print surface starts; and control means for starting the operation associated with the printing on the second print surface according to the standby time set by the standby time setting means after the printing on the first print surface is finished, wherein the retrieval means retrieves information on the amounts of ink applied to each of a plurality sub-areas obtained by dividing the particular area, and the standby time setting means retrieves the respective standby times for the respective sub-areas according to their ink application amounts and sets the longest of the retrieved standby times.

2. An ink jet printing apparatus according to claim 1, wherein the particular area comprises an area extending along an end portion of the first print surface.

3. An ink jet printing apparatus according to claim 2, wherein the particular area comprises areas set at a plurality of locations in the first print surface.

4. An ink jet printing apparatus according to claim 3, wherein the areas set at the plurality of locations have different degrees to which the print medium deflects when applied with ink.

5. An ink jet printing apparatus according to claim 1, wherein the particular area comprises areas extending along at least a front end portion and a rear end portion of the first print surface.

6. An ink jet printing apparatus according to claim 1, wherein the particular area comprises areas extending along left and right side portions of the first print surface.

7. An ink jet printing apparatus according to claim 1, wherein the particular area comprises an area which undesirably contacts or interferes with surrounding members as the print medium is transported during the printing operation on the second print surface.

8. An ink jet printing apparatus according to claim 1, wherein the particular area comprises an area which is printed by the printing unit as the print medium is transported by only one of transport means situated upstream of the printing unit and transport means situated downstream of the printing unit during the printing operation on the second print surface.

9. An ink jet printing apparatus according to claim 1, wherein the standby time setting means sets the standby time according to information indicative of a kind of the print medium and information indicative of an amount of ink applied to the particular area.

10. An ink jet printing apparatus according to claim 1, wherein the information on the ink application amount is information representing the number of print dots to be printed on the particular area.

11. An ink jet printing apparatus for printing on a first print surface and a second print surface of a print medium successively by scanning a printing unit for ejecting ink over the print medium, the ink jet printing apparatus comprising:

ink application amount information retrieval means for retrieving information on an amount of ink applied to a particular area in the first print surface in each scan of the printing unit;

standby time setting means for setting in each scan of the printing unit, according to the information on the ink application amount retrieved by the ink application amount retrieval means, a standby time from when the printing on the first print surface is finished until an operation associated with a printing on the second print surface starts;

remaining time calculation means for calculating a remaining time of each standby time by subtracting a time, which has passed from the end of each scan to the end of the printing operation on the first print surface, from each standby time set by the standby time setting means; and control means for starting the operation associated with the printing on the second print surface according to a longest remaining time calculated by the remaining time calculation means after the printing on the first print surface is finished.

12. An ink jet printing method for printing on a first print surface and a second print surface of a print medium successively by using a printing unit for ejecting ink according to print data, the ink jet printing method comprising:

retrieving information on an amount of ink applied to a particular area in the first print surface;

setting, according to the information on the ink application amount retrieved by the retrieving step, a standby time from when the printing on the first print surface is finished until an operation associated with a printing on the second print surface starts; and starting the operation associated with the printing on the second print surface according to the standby time set by the setting step after the printing on the first print surface is finished, wherein the retrieving step retrieves information on the amounts of ink applied to each of a plurality sub-areas obtained by dividing the particular area, and the standby time setting step retrieves the respective standby times for the respective sub-areas according to their ink application amounts and sets the longest of the retrieved standby times.

13. An ink jet printing method for printing on a first print surface and a second print surface of a print medium successively by scanning a printing unit over the print medium, the ink jet printing method comprising:

retrieving information on an amount of ink applied to a particular area in the first print surface in each scan of the printing unit;

setting in each scan of the printing unit, according to the information on the ink application amount retrieved by the retrieving step, a standby time from when the printing on the first print surface is finished until an operation associated with a printing on the second print surface starts;

calculating a remaining time of each standby time by subtracting a time, which has passed from the end of each scan to the end of the printing operation on the first print surface, from each standby time set by the setting step; and starting the operation associated with the printing on the second print surface according to a longest remaining time calculated by the calculating step after the printing on the first print surface is finished.

* * * * *

UNITED STATES PATENT AND TRADEMARK OFFICE

CERTIFICATE OF CORRECTION

PATENT NO. : 7,360,857 B2
APPLICATION NO. : 11/145932
DATED : April 22, 2008
INVENTOR(S) : Masahiro Koshikawa It is certified that error appears in the above-identified patent and that said Letters Patent is hereby corrected as shown below:

COLUMN 2:
Line 62, after "printing." the right margin should be closed up and "This invention has the following" should be deleted.
Line 63, before "aspects." insert, indented as a new paragraph, -- This invention has the following --.

COLUMN 3:
Line 35, "finished,." should read -- finished. --.

COLUMN 4:
Line 25, "a array" should read -- an array --.

COLUMN 6:
Line 17, "not shown" should read -- (not shown) --.
Line 52, "not shown" should read -- (not shown) --.

COLUMN 13:
Line 43, "an" should read -- a --.

COLUMN 15:
Line 62, "plurality" should read -- plurality of --.

COLUMN 17:
Line 15, "plurality" should read -- plurality of --.

Signed and Sealed this

Twentieth Day of July, 2010

David J. Kappos

David J. Kappos
*Director of the United States Patent and Trademark Office*